US011794239B2

(12) United States Patent
Widler et al.

(10) Patent No.: US 11,794,239 B2
(45) Date of Patent: Oct. 24, 2023

(54) HYDRAULIC DEVICE FOR A DIE CASTING MACHINE

(71) Applicant: BÜHLER AG, Uzwil (CH)

(72) Inventors: Dominik Widler, Kreuzlingen (CH); Beat Eberle, Wallisellen (CH); Lukas Hersche, St. Gallen (CH)

(73) Assignee: BÜHLER AG, Uzwil (CH)

( * ) Notice: Subject to any disclaimer, the term of this patent is extended or adjusted under 35 U.S.C. 154(b) by 0 days.

(21) Appl. No.: 17/595,226

(22) PCT Filed: Mar. 25, 2020

(86) PCT No.: PCT/EP2020/058368
§ 371 (c)(1),
(2) Date: Nov. 11, 2021

(87) PCT Pub. No.: WO2020/229033
PCT Pub. Date: Nov. 19, 2020

(65) Prior Publication Data

US 2022/0203435 A1 Jun. 30, 2022

(30) Foreign Application Priority Data

May 14, 2019 (EP) ..... 19174313

(51) Int. Cl.
*B22D 17/32* (2006.01)
*F15B 13/08* (2006.01)

(52) U.S. Cl.
CPC ..... *B22D 17/32* (2013.01); *F15B 13/0814* (2013.01); *F15B 13/0839* (2013.01); *F15B 13/0892* (2013.01)

(58) Field of Classification Search
CPC ..... B22D 17/32
See application file for complete search history.

(56) References Cited

U.S. PATENT DOCUMENTS

2001/0035277 A1 11/2001 Macheske et al.

FOREIGN PATENT DOCUMENTS

| | | | |
|---|---|---|---|
| CN | 1242486 | A | 1/2000 |
| CN | 1298478 | A | 6/2001 |
| CN | 101198795 | A | 6/2008 |
| CN | 204692215 | U | 10/2015 |
| DE | 10054868 | A1 | 5/2002 |
| EP | 0142281 | A1 | 5/1985 |
| WO | 0237003 | A1 | 5/2002 |

*Primary Examiner* — Kevin P Kerns
*Assistant Examiner* — Steven S Ha
(74) *Attorney, Agent, or Firm* — Colson Law Group, PLLC

(57) ABSTRACT

A device for supplying to and/or controlling hydraulically operated components of a die casting machine, comprising a base block with a main inlet opening and a main outlet opening for hydraulic medium, and also at least two different module components, which are selected from the group consisting of core-pulling modules, core-pulling-relief modules, booster modules, secondary movement modules, and vacuum modules, and which are fluidically connected to the base block. The present invention relates to a die casting machine with such a device and to a method for supplying to and/or controlling hydraulically operated components of a die casting machine.

15 Claims, 6 Drawing Sheets

(Prior art)

HYDRAULIC DEVICE FOR A DIE CASTING MACHINE

The present invention relates to a device for supplying to and/or controlling hydraulically operated components of a die casting machine.

Die casting machines are sufficiently known (see, for example, Brunhuber, Praxis der Druckgussfertigung [The Practice of Die Casting Manufacturing], Berlin, 3rd edition 1980). In a die casting machine, a mold consisting of two halves is closed under high pressure, molten metal (or a metal alloy) is introduced into the closed mold, and after the casting material has solidified, the finished die-cast part can be removed by opening the mold. The mold halves are arranged on a fixed and a movable platen, and the mold is closed by corresponding movement of the movable platen on guide columns toward the fixed platen.

For the operation of the casting mold of a die casting machine, it is necessary for modules to be provided on the die casting machine in order to supply the corresponding components of the die casting machine with hydraulic medium. Usually, these modules are arranged in defined unoccupied areas of the fixed and/or movable platen. The areas available for the modules are small and can generally be used only for the corresponding module but not for other energy modules. The arrangement of the areas for the energy modules depends on the type of die casting machine, i.e., on the spaces available at a specific die casting machine.

Figure 1:
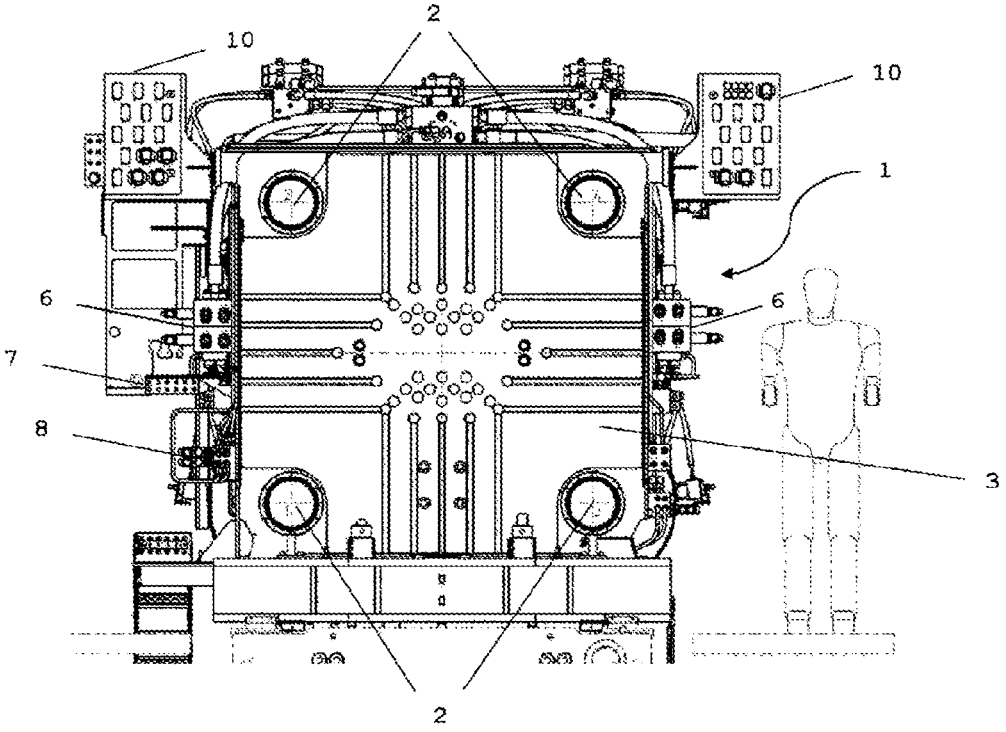

FIG. 1 schematically shows a front view of a die casting machine from the prior art. The die casting machine 1 comprises a (here, by way of example, fixed) platen 3 and openings 2 in the platen 3 for guide columns (not shown) for moving a movable platen (not shown). Modules 10 for supplying the die casting machine with electrical energy, modules 6 for operating core pullers, a module 7 for cooling, and a module 8 for operating a booster are arranged on the sides of the platen 2. The various modules are distributed over the entire die casting machine. The individual hydraulic modules must be connected in a complex manner with pipes and hoses to the hydraulic lines arranged in the machine frame. Depending on the module to be connected, conventional hydraulic connections or special design are to be used. The procedure used in the prior art is not very flexible and requires time-consuming assembly.

Retrofitting of a conventional die casting machine is associated with considerable effort since additional required energy modules can be arranged, if at all, only in the few remaining free areas of the die casting machine. Due to the space problem and the already existing cabling or supply using hoses, already existing energy modules can be relocated only with great effort, if at all.

Retrofitting to a different machine size is also not easily possible with the conventional energy modules since each machine size has different interfaces.

US-2001/0035277 A1 proposes operating several injection-molding units via common energy modules. However, this solution is obviously unsuitable for bulky die casting machines since it takes up an enormous amount of space and, moreover, no plurality of die casting machines are usually operated in sufficient proximity to one another.

The object of the present invention was to provide a device for a die casting machine with which the required supply of hydraulically operated machine components with less space requirement and with a simple, flexible, and easily retrofittable structure can be provided.

This object is achieved by a die casting machine according to claim 1.

In detail, the present invention relates to a device for supplying to and/or controlling hydraulically operated components of a die casting machine, comprising

- a base block having a main inlet opening and a main outlet opening for hydraulic medium, which are preferably arranged on the rear side of the base block, and with connection openings in the top area and the bottom area of the base block for discharging and introducing hydraulic medium, wherein the main inlet opening and the main outlet opening are connected to the connection openings by lines in the base block,
- at least two different module components selected from the group consisting of core-pulling modules, core-pulling-relief modules, booster modules, secondary movement modules, and vacuum modules, and which have connection openings in the top area and the bottom area for discharging and introducing hydraulic medium and lines connecting these openings in their interior, wherein at least one of the module components is arranged in the top area or the bottom area of the base block in such a way that the corresponding connection openings of the module component form a fluidic connection with the corresponding connection openings of the base block, and wherein the at least two different module components have connections for connecting to a hydraulically operated component of the die casting machine,
- end plates for closing unconnected inlet openings and outlet openings of the base block and/or of a module component.

The present invention is based on the concept of combining all hydraulic modules previously distributed over the entire die casting machine into a single block, which is referred to herein as hydraulic tower. This hydraulic tower requires only one connection for supplying hydraulic medium. Within the hydraulic tower, the hydraulic medium is distributed to the individual module components through lines running through all module components. Recirculated hydraulic medium is combined in the hydraulic tower and guided out of the hydraulic tower and away from the die casting machine through a single connection.

In this way, the number of pipes and hoses required for supplying the die casting machine can be considerably reduced. In addition, various numbers and types of module components can be combined in the hydraulic tower according to the invention, which offers a significant increase in flexibility, space-saving, and easy retrofittability. In addition, the operation of the die casting machine is facilitated since all module components are combined in one place. The so-called "footprint" of the die casting machine is optimized.

The hydraulic tower according to the invention can preferably be arranged in a receiving frame on the die casting machine as described in the European patent application entitled "Die casting machine with energy frame" filed by the applicant on the same day.

According to the invention, the die casting machine is preferably a two-platen die casting machine or a three-platen die casting machine.

Components for supplying to and/or controlling hydraulically operated components of a die casting machine are known per se. They are components which are supplied with hydraulic medium and transfers said hydraulic medium in a controlled manner to the corresponding machine components.

Customary liquids, such as mineral oils, oil-in-water emulsions, water-in-oil emulsions, water-glycol mixtures, or anhydrous liquids, such as phosphate esters, can be used as hydraulic medium.

As stated above, such components used in the prior art have separate connections for supplying and discharging hydraulic medium, i.e., separate supply pipes or hoses must be laid to each component. In contrast, the module components according to the invention are designed in such a way that they can be combined into a single block, the hydraulic tower.

The hydraulic tower according to the invention is supplied externally with hydraulic medium only via a single component. This component is referred to as a base block according to the invention. The base block has a preferably cuboid or cubic housing made of a suitable material (for example, a metallic material). For reasons of weight, the base block is preferably a hollow body.

The base block according to the invention preferably has means for fastening the block directly to the die casting machine or in a receiving frame arranged on the die casting machine as described in the European patent application entitled "Die casting machine with energy frame" filed by the applicant on the same day. These means are preferably bore holes for receiving fastening screws. These means are particularly preferably arranged in the side faces of the base block.

The base block according to the invention is equipped with a main inlet opening and a main outlet opening for hydraulic medium. These main openings are preferably arranged on the rear side of the base block so that no possibly interfering large pipes or hoses must be provided on the front side of the hydraulic tower.

The main openings of the base block according to the invention are designed in a customary manner, for example as connections, which can be connected in a sealing, conventional manner to customary pipes or hoses. Sleeve joints are mentioned here by way of example.

The base block according to the invention is furthermore equipped with connection openings in the top area and the bottom area for discharging and introducing hydraulic medium. According to the invention, it is therefore possible to arrange module components in the top area and/or the bottom area of the base block, which can be supplied with hydraulic medium from the base block through said connection openings or can return hydraulic medium to the base block.

For this purpose, as explained below, the further module components have corresponding connection openings which can be connected to the connection openings of the base block in a precisely fitting and sealing manner, i.e., fluidically.

A fluidic connection according to the invention is to be understood as a connection between two lines through which a fluid, preferably a hydraulic medium, can flow in an unimpeded manner and without leakage. These fluidic connections can be realized in a conventional manner, for example by clamp connections equipped with sealing rings.

According to a preferred embodiment of the present invention, the base block and the module components arranged in its top and/or bottom area are connected by fastening means. For this purpose, bore holes for receiving fastening screws or plug-in connections are preferably provided in the top and/or bottom area of the base block, wherein the corresponding fastening screws or plug-in connections are arranged in the corresponding top and/or bottom area of the module components.

According to the invention, the base block and the module components arranged in its top and/or bottom area are particularly preferably connected by one or more threaded rods. These threaded rods are guided through corresponding bore holes of the module components and have one end which can be firmly arranged (for example, screwed in) in a corresponding end bore hole of the base block and/or of a module component. The other end of the threaded rod is either secured within a module component or is located outside in the top area of a module component, where it can be fastened in a known manner (for example, with a nut via a threaded connection). The variant with threaded rods results in a particularly stable hydraulic tower.

The main inlet opening and the main outlet opening of the base block are connected to the connection openings by lines in the base block. These lines are designed in a conventional manner, for example in the form of pipes or in the form of bore holes in a base block in the form of a solid body, such as a cast part.

According to an alternative embodiment of the present invention, the base block can have additional connections for connecting to a hydraulically operated component of the die casting machine. In this case, the base block serves not only to distribute hydraulic medium to other module components, but also to control a hydraulically operated component of the die casting machine.

According to a preferred embodiment, an ejector cylinder is operated with the aid of the base block, i.e., a cylinder installed in the movable platen of a die casting machine, with which the cast part is ejected from the mold once the casting process has ended.

In this alternative embodiment, secondary lines, which lead to the additional connections preferably via a unit for modifying the flow of hydraulic medium, preferably a valve, branch off from the lines in the base block that lead from the main openings to the connection openings in the top and bottom area of the base block.

The amount of hydraulic medium to be supplied to the machine component, such as the ejector cylinder, can be adjusted using the unit for modifying the flow of hydraulic medium, preferably a valve. As needed, this can be a simple black and white valve, a positioning valve, or a proportional valve. Such valves are known.

The black and white valve can be, for example, a 4/3-way solenoid valve with which the ejector cylinder can be moved to its end position and back again.

The positioning valve can consist of a combination of three valves, with the aid of which a very accurate movement of the cylinder in a predetermined position can be achieved with an accuracy of, for example, ±1 mm. For example, it can be a combination of a 4/3-way solenoid valve (main valve) with two 2/2-way solenoid valves (secondary valves) which are arranged such that in the event of an emergency, when the main valve is in the closed position, hydraulic medium can flow off via the secondary valves to prevent excess pressure in the line.

The proportional valve can be a 4/3-way solenoid valve with integrated control, which allows very precise movement and positioning of the cylinder as a function of a position determination of the cylinder.

The valve is preferably arranged on the side of the base block on which the main openings are located. The additional connections for connecting the base block to a machine component, such as the ejector cylinder, are preferably arranged laterally on the base block with alignment toward the rear. The additional connections can be connected to conventional pipes or hoses in a conventional, sealing manner. Sleeve joints are mentioned here by way of example.

At least one further module component is arranged in the top area of the base block, as described above. This further module component may be selected from the group consisting of core-pulling modules, core-pulling-relief modules, booster modules, secondary movement modules, and vacuum modules.

According to the invention, a core-pulling module is preferably arranged in the top area of the base block.

A core-pulling module is used to control a core-pulling cylinder which moves a movable core or in general a movable mold part) in the mold. The mold of the cast part to be cast can be modified using these movable cores. Core-pulling modules are used to hydraulically move cores (or, in general, mold parts) out of the mold that are not mechanically removed through the opening of the mold.

Movable cores and core-pulling cylinders are sufficiently known. Generally, several, for example 1 to 10 and preferably 1 to 5, core-pulling cylinders and movable cores are provided in a casting mold of a die casting machine. An associated core-pulling module is to be provided for each core-pulling cylinder. The core-pulling module according to the invention can be used to move a core-pulling cylinder and preferably, in addition, to carry out a pressure reduction.

A core-pulling module according to the invention has a preferably cuboid or cubic housing made of a suitable material (for example, a metallic material). For reasons of weight, the core-pulling module is preferably a hollow body. According to a preferred embodiment of the present invention, fastening screws or plug-in connections are preferably arranged in the bottom area of the core-pulling module in order to connect the core-pulling module to the base block. Bore holes for receiving corresponding fastening means of a core-pulling module arranged thereabove are preferably provided in the top area of the core-pulling module. According to the invention, however, continuous bore holes through which threaded rods can be guided as described above are particularly preferably provided in the core-pulling module. In addition, means for fastening the core-pulling module directly to the die casting machine or in a receiving frame arranged on the die casting machine as described in the European patent application entitled "Die casting machine with energy frame" filed by the applicant on the same day can be provided in the side faces of a core-pulling module. These means are preferably bore holes for receiving fastening screws.

According to a preferred embodiment of the present invention, a means for lifting the core-pulling module is provided in the top area of the core-pulling module. This is preferably a bore hole for fixedly arranging an eye screw or hook in order to be able to lift the core-pulling module with a cable fastened thereto by means of a crane.

A core-pulling module according to the invention has connection openings in the top area and the bottom area for discharging and introducing hydraulic medium. In the case of a core-pulling module arranged in the top area of the base block, these connection openings are fluidically connected to the corresponding connection openings of the base block as described above. The connection openings of the core-pulling module are designed analogously to the above-described connection openings of the base block.

In its interior, a core-pulling module according to the invention has lines which connect the connection openings in the top area and the bottom area to one another. If several core-pulling modules are arranged one above the other, all core-pulling modules are connected to one another via their inner lines and can be supplied with hydraulic medium by the base block or can return hydraulic medium to the base block.

A core-pulling cylinder is operated using a core-pulling module. For this purpose, secondary lines, which lead to the connections for the core-pulling cylinder preferably via a unit for modifying the flow of hydraulic medium, preferably a valve, branch off from the lines in the core-pulling module that lead from the connection openings in the bottom area of the core-pulling module to the connection openings in the top area of the core-pulling module.

The valve is preferably arranged on the rear side of the core-pulling module. The connections for connecting the core-pulling module to a core-pulling cylinder are preferably arranged on the front side of the core-pulling module and are thus easily accessible to the operating personnel. The additional connections can be connected to conventional pipes or hoses in a conventional, sealing manner. Sleeve joints are mentioned here by way of example.

According to a further embodiment of the present invention, additional connections can be provided, preferably in a side face of the core-pulling module, which connections can also be supplied with or return hydraulic medium via a unit for modifying the flow of hydraulic medium, preferably a valve.

The valve can be, for example, a 4/3-way solenoid valve with which the core-pulling cylinder can be moved to its end position and back again.

A distribution element can preferably be provided on at least one connection in order to additionally increase the available number of connections. This distribution element has, for example, an inlet which is fluidically connected to a connection of the core-pulling module, and at least two outlets for connecting to machine components.

According to a particularly preferred embodiment of the present invention, the core-pulling module according to the invention has the function of reducing pressure. In this case, the core-pulling module furthermore comprises a pressure-reducing valve which is arranged between the line comprising pressurized hydraulic medium and coming from the base block, and the valve described above. Pressure-reducing valves are sufficiently known. The pressure-reducing valve can preferably be controlled using an operating element, for example a rotary control. The operating element is preferably located on the front side of the core-pulling module, next to the connections for the core-pulling cylinder.

Furthermore, according to this embodiment, the core-pulling module may comprise a connection for measuring pressure. A conventional pressure measuring instrument, such as a manometer, can be connected to this connection in order to determine the pressure applied in the core-pulling module and to, if necessary, modify it using the pressure-reducing valve. The connection for pressure measurement is preferably located on the front side of the core-pulling module, next to the connections for the core-pulling cylinder.

According to this embodiment, it is possible to separately determine and change the pressure in each core-pulling module in the event that a plurality of core-pulling modules is provided in the hydraulic tower.

According to a further embodiment of the present invention, a safety module can be provided on the core-pulling module, which safety module is arranged in the hydraulic circuit between the above-described valve and the core-pulling cylinder and prevents an undesired movement of the core-pulling cylinder caused by its own weight.

In the hydraulic tower according to the invention, all core-pulling modules provided are preferably arranged one above the other and in the top area of the base block. A continuous hydraulic flow is possible by means of the lines present in the base block and in all core-pulling modules.

According to a preferred embodiment, a core-pulling-relief module is arranged above the core-pulling module or the core-pulling modules, i.e., in the top area of the uppermost core-pulling module. Pressure present in the lines can be discharged from the hydraulic tower to the tank using the core-pulling-relief module so that, for example, connections to machine components can be easily released. For this purpose, the core-pulling-relief module has lines which can be fluidically connected to the connection openings in the top area of the uppermost core-pulling module and which lead to a relief valve. When the relief valve is actuated, the lines are connected to the tank. A core-pulling-relief module according to the invention has a preferably cuboid or cubic housing made of a suitable material (for example, a metallic material). For reasons of weight, the core-pulling-relief module is preferably a hollow body. The relief valve is preferably arranged on the rear side, i.e., in the hydraulic tower on the side facing away from the connections and operating elements.

According to an alternative embodiment of the present invention, instead of a core-pulling-relief module, may also have an end plate for closing the connection openings in the top area of the uppermost core-pulling module. This is a plate made of a suitable material (for example, a metallic material) with required dimensions for closing the connection openings, which can be fastened to the top area of the uppermost core-pulling module, for example by helical connections.

The hydraulic tower according to the invention can furthermore comprise at least one booster module, for example 1 to 10 and preferably 1 to 5 booster modules. The booster modules serve for actuating booster cylinders in order to additionally pressurize and thus compress casting material in the casting mold before solidification.

The design of the booster module according to the invention preferably substantially corresponds to the above-described core-pulling module with a pressure-reducing valve so that the above statements relating to the core-pulling module apply analogously. In addition, however, the booster module preferably has a throttle valve. Two lines branch off from the lines leading through the booster module from the connection openings in the bottom area to the connection openings in the top area, one of which two lines leads to one of the connections via a unit, preferably a valve, particularly preferably a 4/3-way way solenoid valve, for modifying the flow of hydraulic medium. After leaving the valve, the other branching-off line is first guided through a pressure-reducing valve and then through a throttle valve known per se, before it is guided to the other connection. In this way, the piston chamber side of the booster cylinder can be influenced in a targeted manner using the additional valves.

For the additional throttle valve, an operating element, for example a rotary control, is preferably also provided for control. The operating element is preferably located on the front side of the booster module next to the connections for the booster cylinder. The design of the vacuum module according to the invention preferably substantially corresponds to the above-described core-pulling module with a pressure-reducing valve so that the above statements relating to the core-pulling module apply analogously.

The booster module(s) are preferably arranged above the core-pulling module(s). In this case, the end plate described above is arranged in the top area of the uppermost booster module (and not in the top area of the uppermost core-pulling module).

The hydraulic tower according to the invention can furthermore comprise at least one vacuum module, with the aid of which a cylinder for influencing a vacuum in the casting mold can be actuated.

The hydraulic tower according to the invention can furthermore comprise at least one secondary movement module. Secondary movements are understood to mean hydraulically operated movements of machine components which do not relate to the main hydraulic machine movements (such as closing the casting mold). Exemplary secondary movements in a die casting machine are the movements of the clamping mechanism in the fixed platen for the guide columns, the movement of the clamping cylinders, the movement of the cylinders for the horizontal movement of the mold carrier, or the movement of the cylinders for ejecting the casting mold.

The secondary movement module(s) are preferably arranged below the base block, wherein a secondary movement module is fluidically connected to the bottom area of the base block, analogously to the fluidic connection of a core-pulling module to the top area of the base block.

If several secondary movement modules are present in the hydraulic tower, they are preferably combined as a unit and arranged in the bottom area of the base block. Analogously to the core-pulling modules and booster modules described above, the secondary movement modules are also firmly connected to one another and to the base block, for example by means of helical connections or preferably with one or more threaded rods, which are guided through bore holes in the secondary movement modules.

According to the present invention, an end plate for closing the connection openings in the bottom area of the base block (if no secondary movement modules are present) or the bottom area of the lowest secondary movement module is have. This is a plate made of a suitable material (for example, a metallic material) with required dimensions for closing the connection openings, which can be fastened to the bottom area of the base block (if no secondary movement modules are present) or to the bottom area of the lowest secondary movement module, for example by means of helical connections. In addition, means for fastening the secondary movement module directly to the die casting machine or in a receiving frame arranged on the die casting machine can be provided in the side faces of a secondary movement module, as described in the European patent application entitled "Die casting machine with energy frame" filed by the applicant on the same day. These means are preferably bore holes for receiving fastening screws.

A secondary movement module according to the invention has a preferably cuboid or cubic housing made of a suitable material (for example, a metallic material). For reasons of weight, the secondary movement module is preferably a hollow body.

A secondary movement module according to the invention has connection openings in the top area and the bottom area for discharging and introducing hydraulic medium. In the case of a secondary movement module arranged in the bottom area of the base block, these connection openings are fluidically connected to the corresponding connection openings of the base block, as described above. The connection openings of the secondary movement module are designed analogously to the above-described connection openings of the base block.

In its interior, a secondary movement module according to the invention has lines which connect the connection openings in the top area and the bottom area to one other. If several secondary movement modules are arranged one above the other, all secondary movement modules are connected to one another via their inner lines and can be supplied with hydraulic medium by the base block or can return hydraulic medium to the base block.

The secondary movement module is used to operate a cylinder by means of which secondary movements are triggered. For this purpose, secondary lines, which lead to the connections for the cylinder preferably via a unit for modifying the flow of hydraulic medium, preferably a valve, branch off from the lines in the secondary movement module that lead from the connection openings in the bottom area of the secondary movement module to the connection openings in the top area of the secondary movement module.

The various secondary movement modules differ in terms of type and number of valves that have to be provided on the secondary movement module in order to carry out the respective secondary movement. The valve arrangement required for a specific secondary movement is known to the person skilled in the art.

According to a particularly preferred embodiment of the present invention, in the hydraulic tower described above, all connections provided on module components (i.e., the main connections, with the exception of any secondary connections arranged on a side face) for connecting to a hydraulically operated component of the die casting machine and all operating elements are arranged on one side, preferably on the side facing away from the main inlet opening and the main outlet opening. An operator standing in front of the hydraulic tower can thus easily operate and use the hydraulic tower.

As already explained above, the hydraulic tower according to the invention is provided for supplying to and/or controlling hydraulically operated components of a die casting machine. The present invention thus also relates to a die casting machine comprising at least one device described above (hydraulic tower) which is arranged on the die casting machine by means of fastening means.

According to a preferred embodiment of the present invention, the die casting machine furthermore comprises at least one receiving frame for energy modules, wherein the receiving frame comprises:

- fastening means for fastening the receiving frame on the die casting machine,
- at least one, preferably 1 to 3, rows for receiving energy modules, wherein each row comprises two profile pieces which are connected to one another, preferably at their ends, by a respective connecting piece or energy module, forming a quadrangular, preferably rectangular interior space, wherein the rows have means for arranging energy modules in their interior space and, if there is a plurality of rows, are connected to one another, and wherein the fastening means for fastening the receiving frame on the die casting machine are arranged on a row forming an outer face of the receiving frame, and the receiving frame is fastened to the die casting machine via the fastening means, preferably forming an interspace between the die casting machine and the row adjacent to the die casting machine, characterized in that the device (hydraulic tower) described above is arranged in the row of the receiving frame adjacent to the die casting machine.

Energy modules within the meaning of the present invention are devices with which components of the die casting machine can be supplied with energy, for example in the form of electrical energy or in the form of a pressurized hydraulic medium. Such energy modules are conventionally known and available. They are basically box-shaped, have connections for supplying and discharging electrical current or hydraulic medium, and possibly operating elements, such as switches, control knobs, etc.

According to a particularly preferred embodiment of the present invention, the device described above (hydraulic tower) is arranged in the row of the receiving frame adjacent to the die casting machine in such a way that the base block of the device connects the profile pieces of the row at the bottom.

According to a particularly preferred embodiment of the present invention, 1 to 5 core-pulling modules are arranged above the base block, 1 to 5 booster modules are arranged above the core-pulling modules, and 1 to 5 secondary movement modules are arranged below the base block.

According to a further preferred embodiment of the present invention, the die casting machine has a movable platen which, on both sides, has the receiving frame with a device (hydraulic tower) arranged in the row of the receiving frame adjacent to the die casting machine. In this case, the device particularly preferably comprises, on one side of the movable platen, a base block that has connections for connecting ejector cylinders.

Such a die casting machine with receiving frame is described in detail in the European patent application entitled "Die casting machine with energy frame" filed by the applicant on the same day.

The present invention furthermore relates to a method for supplying to and/or controlling hydraulically operated components of a die casting machine, comprising the steps of

- Providing a device (hydraulic tower) described above on the die casting machine,
- Introducing hydraulic medium into the base block of the device,
- Transferring the hydraulic medium through at least one connection connected to a hydraulically operated component of the die casting machine in at least one module component and/or the base block.

According to the invention, the transferring of the hydraulic medium is preferably modified by at least one unit, preferably a valve.

The present invention is explained in more detail below with reference to non-restrictive drawings. The following is shown:

FIG. 1 a front view of a die casting machine from the prior art

Figure 2:
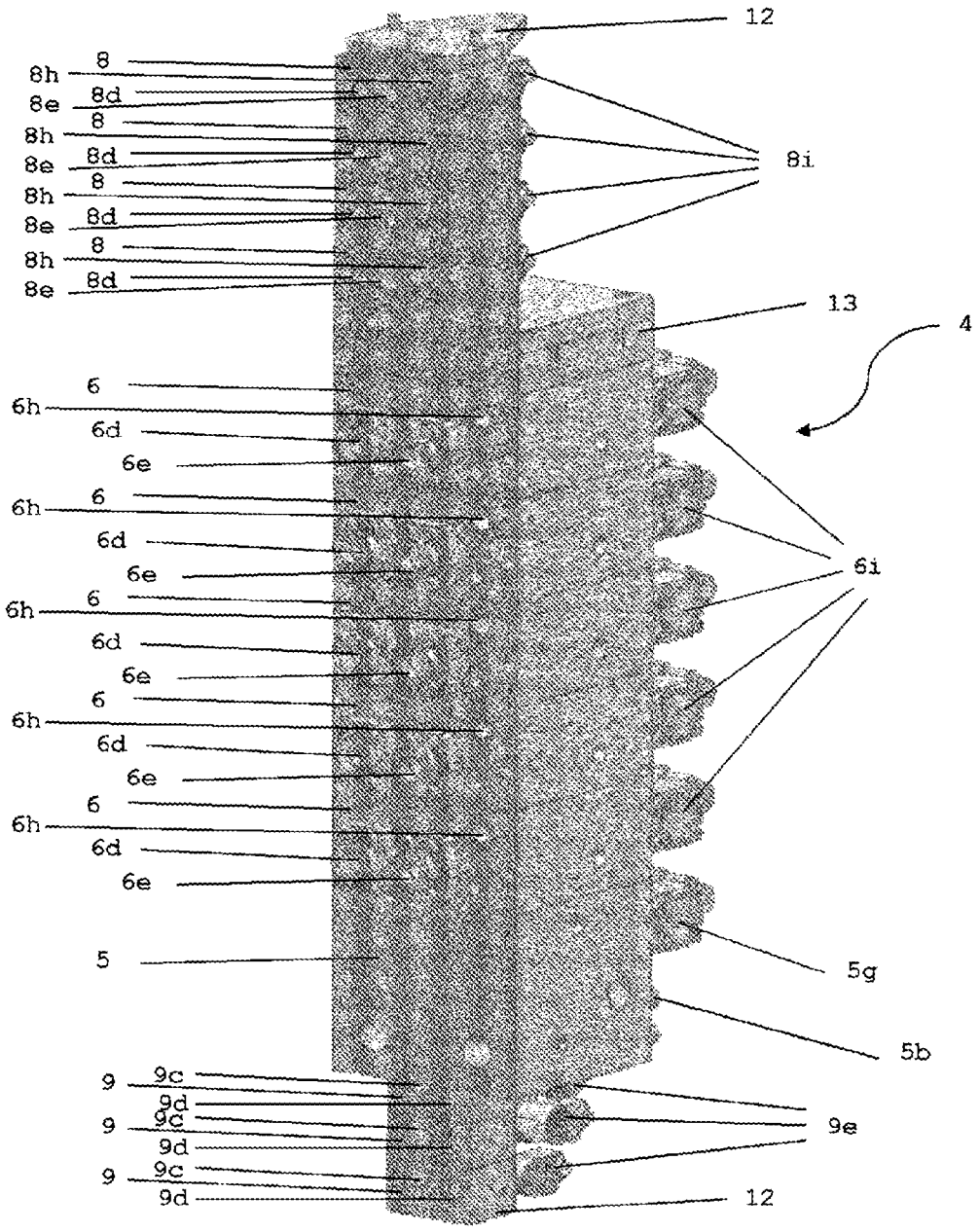

FIG. 2 a schematic view of a hydraulic tower according to the invention

Figure 3:
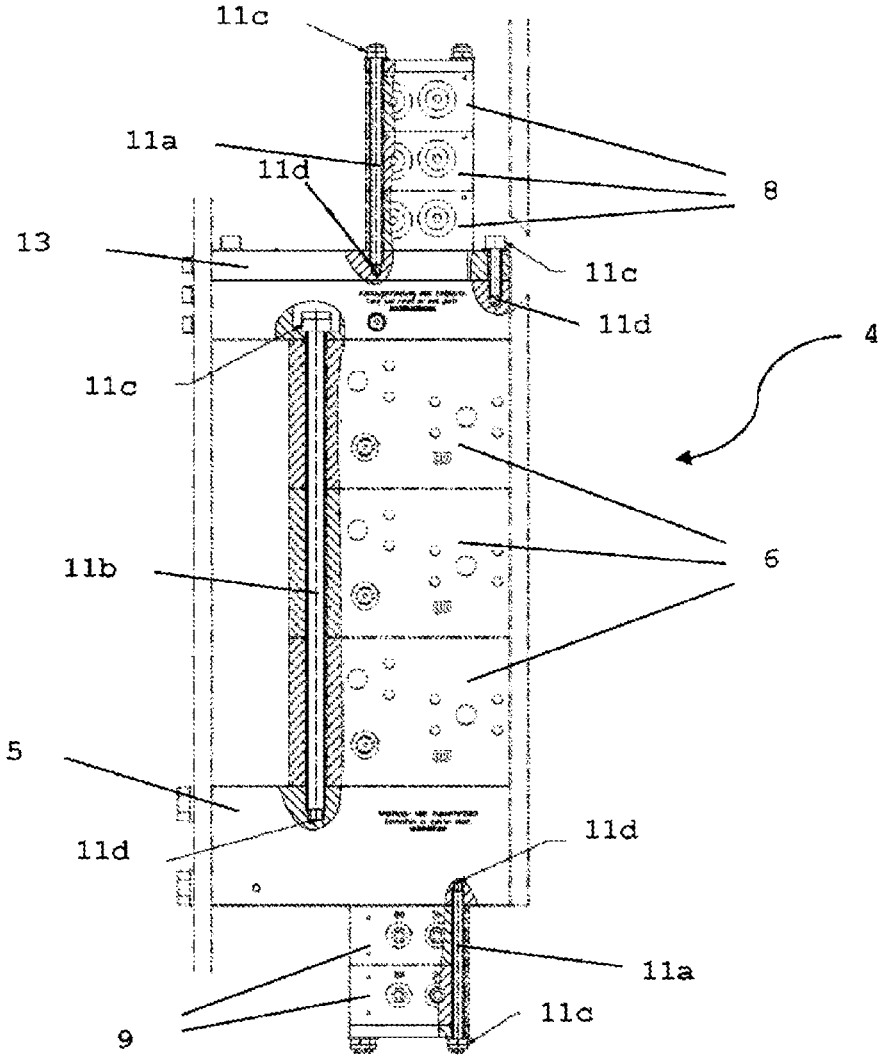
Figure 4A:
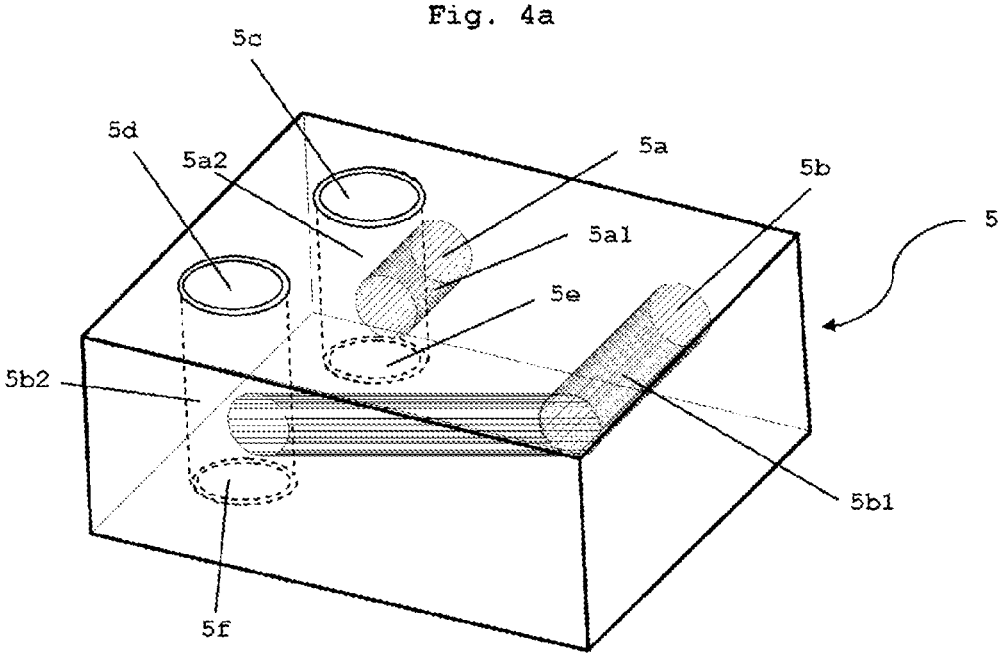
Figure 4B:
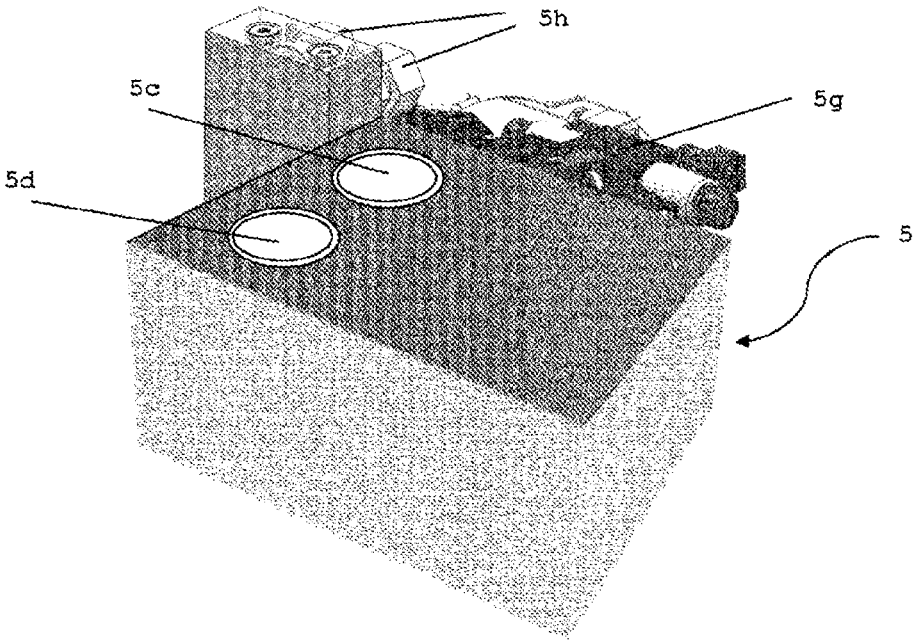
Figure 5A:
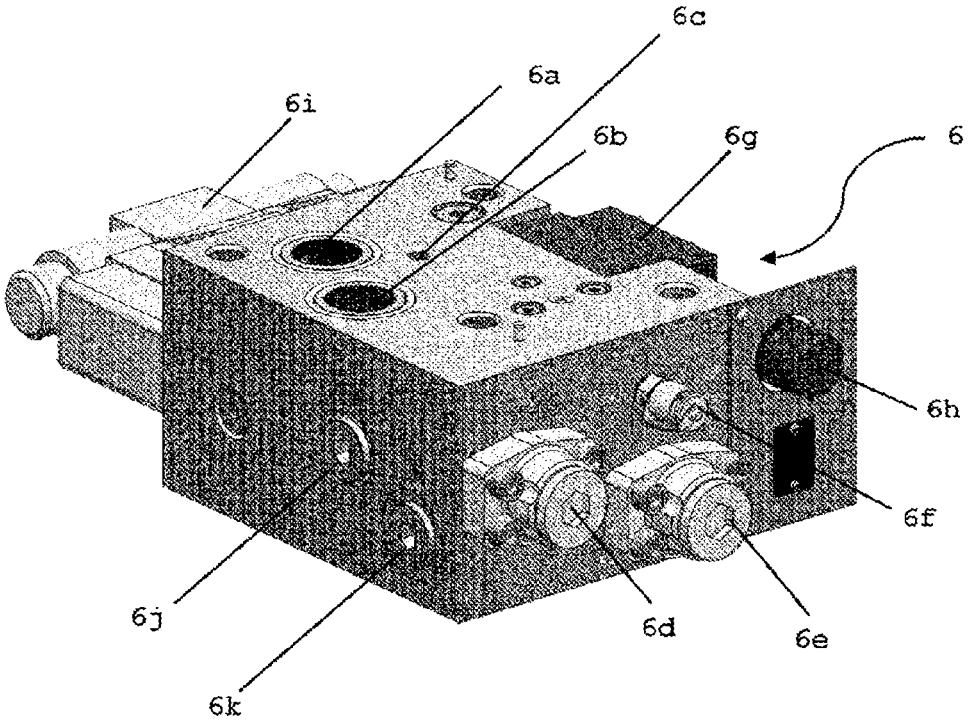
Figure 5B:
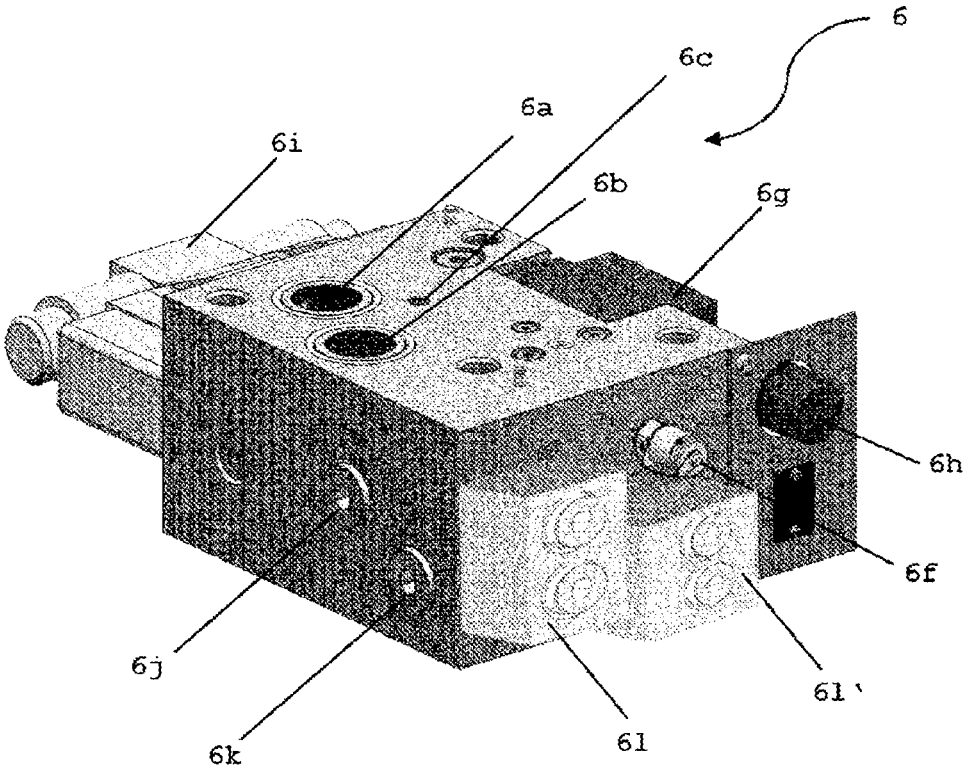
Figure 6:
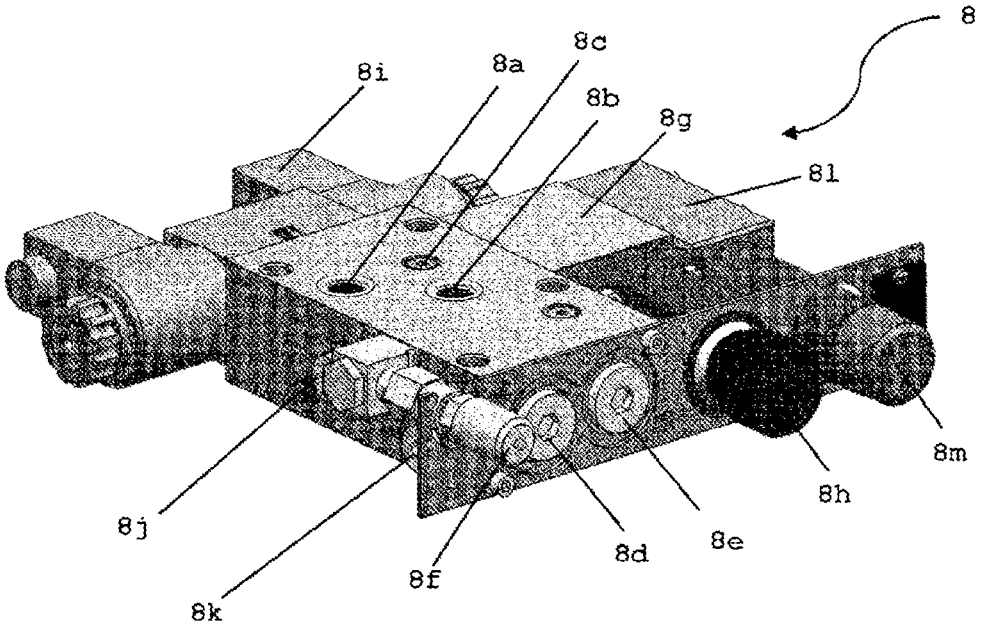
Figure 7:
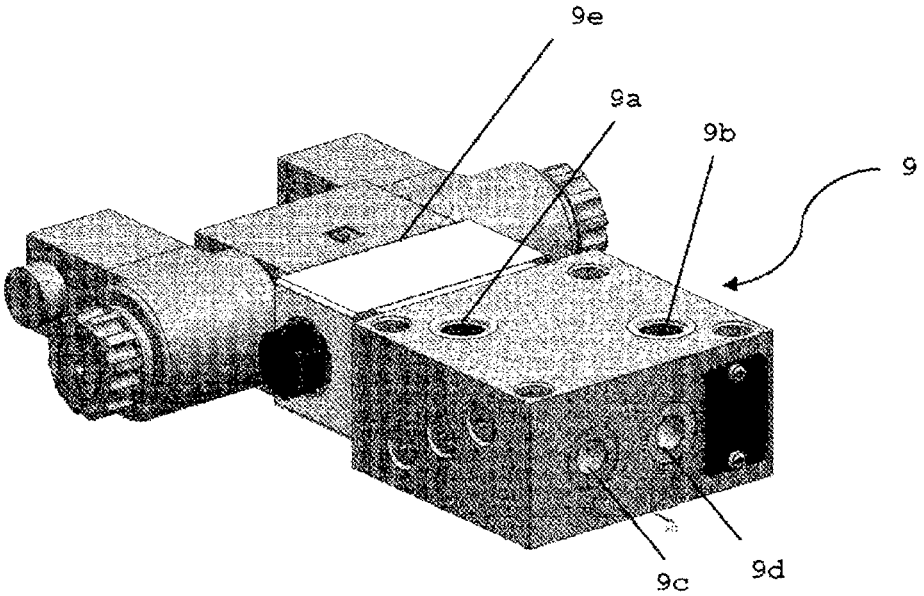

FIG. 3 a schematic view of an embodiment of a hydraulic tower according to the invention with threaded rods for fastening the individual module components FIG. 4A a schematic view of an embodiment of a base block of the hydraulic tower according to the invention FIG. 4B a schematic view of another embodiment of a base block of the hydraulic tower according to the invention FIG. 5A a schematic view of an embodiment of a core-pulling module of the hydraulic tower according to the invention FIG. 5B a schematic view of another embodiment of a core-pulling module of the hydraulic tower according to the invention FIG. 6 a schematic view of an embodiment of a booster module of the hydraulic tower according to the invention FIG. 7 a schematic view of an embodiment of a secondary movement module of the hydraulic tower according to the invention In the drawings, the same reference signs designate the same components.

FIG. 1 schematically shows a front view of a die casting machine from the prior art. The die casting machine 1 comprises a (here, by way of example, fixed) platen 3 and openings 2 in the platen 3 for guide columns (not shown) for moving a movable platen (not shown). Modules 10 for supplying the die casting machine with electrical energy, modules 6 for operating core pullers, a module 7 for cooling, and a module 8 for operating a booster are arranged on the sides of the platen 2. The various modules are distributed over the entire die casting machine. The individual hydraulic modules must be connected in a complex manner with pipes and hoses to the hydraulic lines arranged in the machine frame.

FIG. 2 shows a schematic view of a hydraulic tower 4 according to the invention. This hydraulic tower 4 comprises a base block 5 with a main inlet opening 5*a* (not shown) and a main outlet opening 5*b*. According to the embodiment shown in FIG. 2, the base block 5 has a valve 5*g* with the aid of which hydraulic medium can be delivered in a controlled manner to additional connections 5*h* (not shown), for example for controlling an ejector cylinder.

A block of (in this embodiment) 5 core-pulling modules 6 is arranged in the top area of the base block 5. The core-pulling modules 6 each have connections 6*d*, 6*e* on their front side for connecting to a core-pulling cylinder and a valve 6*i* on their rear side, with the aid of which hydraulic medium can be delivered in a controlled manner to the connections 6*d*, 6*e*. The valves 6*i* can be regulated via pressure regulators 6*h*.

The core-pulling modules 6 are fluidically connected to the base block 5 and to one another via connection openings (not shown in FIG. 2) so that hydraulic medium can circulate from the base block 5 through all core-pulling modules 6 and be delivered via the connections 6*d*, 6*e*.

A core-relief module 13 is arranged on the uppermost core-pulling module 6. As described above, the core-relief module 13 serves to relieve pressure in the hydraulic lines in the hydraulic tower 4 using a relief valve (not shown in FIG. 2).

A block of (in FIG. 2) 4 booster modules 8 is arranged in the top area of the core-relief module 13. The booster modules 8 each have connections 8*d*, 8*e* on their front side for connecting to a booster cylinder and at least one valve 8*i* on their rear side, with the aid of which hydraulic medium can be delivered in a controlled manner to the connections 8*d*, 8*e*. The valves 8*i* can be regulated via pressure regulators 8*h*. Each booster module can additionally have a respective pressure-reducing valve (not shown in FIG. 2) and throttle valve with associated regulators.

The booster modules 8 are fluidically connected to the base block 5, the core-pulling modules 6, the core-relief module 13, and to one another via connection openings (not shown in FIG. 2) so that hydraulic medium can circulate from the base block 5 through all booster modules 8 and be delivered via the connections 8*d*, 8*e*.

An end plate 12 for closing the lines passing through the hydraulic tower 4 is fastened to the top area of the uppermost booster module 8.

A block of (in FIG. 2) 3 secondary movement modules 9 is arranged in the bottom area of the base block 5. The booster modules 9 each have connections 9*c*, 9*d* on their front side for connecting to a secondary movement cylinder and at least one valve block 9*e* on their rear side, with the aid of which hydraulic medium can be delivered in a controlled manner to the connections 9*c*, 9*d*.

An end plate 12 for closing the lines passing through the hydraulic tower 4 is fastened to the bottom area of the lowest secondary movement module 9.

FIG. 3 shows a schematic view of an embodiment of a hydraulic tower according to the invention with threaded rods for fastening the individual module components. Threaded rods 11*a*, 11*b* of different lengths are guided through bore holes in the module components 5, 6, 8, 9, 13. One end 11*d* of the threaded rods 11*a*, 11*b* is fastened, for example screwed, to an end bore hole of a module component. The other end 11*c* of the threaded rods 11*a*, 11*b* is fixed by means of a groove. In the manner shown in this embodiment, a firm connection of the module components is ensured. The hydraulic tower 4 is very stable and withstands the forces occurring during operation of a die casting machine.

FIG. 4A shows a schematic view of an embodiment of a base block 5 of the hydraulic tower 4 according to the invention.

The base block has a main inlet opening 5*a* which is fluidically connected via lines 5*a*1, 5*a*2 (for example, pipes in a hollow body or bore holes in a solid body) to a connection opening 5*c* in the top area of the base block 5 and a connection opening 5*e* in the bottom area of the base block 5. Hydraulic medium introduced into the base block 5 through the main inlet opening 5*a* can be distributed to module components (not shown here) through the connection openings 5*c*, 5*e*, which module components are arranged in the top area or bottom area of the base block 5.

The base block 5 furthermore has a main outlet opening 5*ba* which is fluidically connected via lines 5*b*1, 5*b*2 to a connection opening 5*d* in the top area of the base block 5 and a connection opening 5*f* in the bottom area of the base block 5. Hydraulic medium can be conducted from the base block 5 into a tank (not shown) through the main outlet opening 5*b*. The hydraulic medium to be conducted out can be introduced into the base block 5 through the connection openings 5*d*, 5*f* of module components (not shown here), which are arranged in the top area or bottom area of the base block 5.

FIG. 4B shows a schematic view of another embodiment of a base block 5 of the hydraulic tower 4 according to the invention. This base block 5 differs from the embodiment shown in FIG. 4A in that connections 5*h* for connecting the base block 5 to a machine component, preferably an ejector cylinder, and a valve 5*g* for regulating the hydraulic flow to the connections 5*h* are arranged on the base block 5. Secondary lines lead from the lines 5*a*2, 5*b*2 (not shown in FIG. 4B) into the valve 5*g* and from there to the connections 5*h*, as described in detail above.

FIG. 5A shows a schematic view of an embodiment of a core-pulling module 6 of the hydraulic tower 5 according to the invention.

In its interior, the core-pulling module 6 has lines (not shown) which are fluidically connected to connection openings 6*a*, 6*b* in the top area of the core-pulling module 6 and connection openings (not shown) in the bottom area of the core-pulling module 6. Secondary lines lead from the lines (not shown) into the valve 6*i* or via the pressure-reducing valve 6*g* into the valve 6*g* and from there to the connections 6*d*, 6*e*, as described in detail above. The connections 6*d*, 6*e* can be connected to a core-pulling cylinder.

The pressure-reducing valve 6*g* can be regulated using a pressure regulator 6*h*. In addition, a connection 6*f* for pressure measurement is provided on the front side of the core-pulling module 6, to which connection a conventional pressure measuring instrument, such as a manometer, can be connected.

In the embodiment according to FIG. 5*a*, a bore hole 6*c* for receiving an eye screw) (not shown) is provided in the top area of the core-pulling module 6. The core-pulling module 6 can be lifted and installed or removed in a simple manner using such an eye screw.

In the embodiment according to FIG. 5*a*, additional secondary connections 6*j*, 6*k* are provided on one side face. These secondary connections are hydraulically connected analogously to the connections 6*d*, 6*e* and serve for connecting to an optional hydraulic distributor (not shown).

FIG. 5B shows a schematic view of another embodiment of a core-pulling module 6 of the hydraulic tower 5 according to the invention. This core-pulling module 6 differs from the embodiment shown in FIG. 4A in that a distribution element 6*l*, 6*l'* is arranged on each of the connections 6*d* and 6*e* in order to increase (in this case double) the number of available connections.

FIG. 6 is a schematic view of an embodiment of a booster module 8 of the hydraulic tower 5 according to the invention.

In its interior, the booster module 8 has lines (not shown) which are fluidically connected to connection openings 8*a*, 8*b* in the top area of the booster module 8 and connection openings (not shown) in the bottom area of the booster module 8. Secondary lines lead from the lines (not shown) into the valve 8*i* or via the pressure-reducing valve 8*g* and the throttle valve 8*l* into the valve 8*g* and from there to the connections 8*d*, 8*e*, as described in detail above. The connections 8*d*, 8*e* can be connected to a booster cylinder.

The pressure-reducing valve 8*g* can be regulated using a pressure regulator 8*h*. The throttle valve 8*l* can be regulated using a regulator 8*m*. In addition, a connection 8*f* for pressure measurement is provided on the front side of the booster module 8, to which connection a conventional pressure measuring instrument, such as a manometer, can be connected.

In the embodiment according to FIG. 6, a bore hole 8*c* for receiving an eye screw) (not shown) is provided in the top area of the booster module 8. The booster module 8 can be lifted and installed or removed in a simple manner using such an eye screw.

In the embodiment according to FIG. 6, additional secondary connections 8*j*, 8*k* are provided on one side face. These secondary connections are hydraulically connected analogously to the connections 8*d*, 8*e* and serve for connecting to an optional hydraulic distributor (not shown).

FIG. 7 is a schematic view of an embodiment of a secondary movement module 9 of the hydraulic tower according to the invention.

In its interior, the secondary movement module 9 has lines (not shown) which are fluidically connected to connection openings 9*a*, 9*b* in the top area of the secondary movement module 9 and connection openings (not shown) in the bottom area of the secondary movement module 9. Secondary lines lead from the lines (not shown) into the valve block 9*e* and from there to the connections 9*c*, 9*d*, as described in detail above. The connections 9*c*, 9*d* can be connected to a secondary movement cylinder.

The invention claimed is:

1. A device for supplying to and/or controlling hydraulically operated components of a die casting machine, comprising:

a base block having a main inlet opening and a main outlet opening that transports a hydraulic medium the main inlet opening and the main outlet opening disposed at a side of the base block, and a plurality of base block connection openings and the bottom area disposed at top and bottom sides of the base block, the plurality of base block connection openings discharging and introducing the hydraulic medium, wherein the main inlet opening and main outlet opening are connected to the top and bottom side base block connection openings by fluidic lines in the base block;

at least two different module components selected from the group consisting of core-pulling modules, core-pulling-relief modules, booster modules, secondary movement modules, and vacuum modules, each of the at least two different module components having module connection openings disposed at top and bottom sides thereof, the module connection openings discharging and introducing the hydraulic medium, and interior fluidic lines connecting the top and bottom side module connection openings, wherein at least one of the two at least two different module components is arranged at the top side or the bottom side of the base block such that the module connection openings thereof form a fluidic connection with the corresponding base block connection openings, and wherein the at least two different module components have fluidic connections to the hydraulically operated components of the die casting machine; and, end plates that close unconnected inlet openings and outlet openings of the base block and/or of a connected module component.

2. The device according to claim 1, wherein at least one further module component is arranged at a top side or a bottom side of at least one of the at least two different module components, the at least one further module component is selected from the group consisting of core-pulling modules, core-pulling-relief modules, booster modules, secondary movement modules, and vacuum modules, and the at least one further module component has, at top and bottom sides thereof, further module connection openings discharging and introducing the hydraulic medium, and interior fluidic lines connecting the top and bottom side further module connection openings, wherein the at least one further module component is arranged at a top side or a bottom side of an adjacent module component such that the corresponding further module connection openings of the at least one further module component form a fluidic connection with corresponding adjacent module connection openings of the adjacent module component, and wherein the at least one further module component has fluidic connections for connecting to the hydraulically operated components of the die casting machine.

3. The device according to claim 1, wherein the base block and the at least two different module components are connected by fastening means comprising one or more threaded rods.

4. The device according to claim 1, wherein a distribution unit having at least one fluidic connection is connects to the hydraulically operated components of the die casting machine.

5. The device according to claim 1, wherein the base block has a fluidic connection to the hydraulically operated components of the die casting machine.

6. The device according to claim 1, wherein the base block, and at least one of the at least two module components include a valve that modifies flow of the hydraulic medium.

7. The device according to claim 6, wherein the base block or the at least one of the at least two module components include an operating element, and the base block connection openings, the module connection openings, and the operating element are arranged on a same side opposite the main inlet opening and the main outlet opening of the base block.

8. The die casting machine according to claim 1, wherein at least one or more of the base block, the at least two different module components, the end plates, and any additional module units or operating elements, are connected by fastening means.

9. The die casting machine according to claim 8, wherein the die casting machine furthermore comprises at least one receiving frame that receives at least one energy module, the at least one receiving frame comprising:

fastening means for fastening the at least one receiving frame on the die casting machine, at least one row that receives the at least one energy module, wherein the at least one row comprises two profile pieces which are connected to one another by a respective connecting piece or energy module thereby forming a quadrangular interior space, wherein the at least one row has means for arranging the at least one energy module in the interior space thereof, wherein the fastening means that fastens the at least one receiving frame on the die casting machine is arranged on a row forming an outer face of the at least one receiving frame, and the at least one receiving frame is fastened to the die casting machine via the fastening means, wherein the base block includes a main inlet opening and a main outlet opening for the hydraulic medium arranged on a rear side of the base block, and the plurality of base block connection openings are disposed in the top side and the bottom side of the base block discharge and introduce the hydraulic medium, wherein the main inlet opening and main outlet opening are connected to the plurality of base block connection openings by fluidic lines in the base block, the at least two different module components selected from the group consisting of core-pulling modules, core-pulling-relief modules, booster modules, secondary movement modules, and vacuum modules, each have the module connection openings in a top side and a bottom side thereof that discharge and introduce the hydraulic medium, and fluidic lines in their respective interiors that connect the module connection openings, wherein at least one of the at least two different module components is arranged in the top side or the bottom side of the base block such that the corresponding module connection openings of the at least one module component forms a fluidic connection with the corresponding base block connection openings of the base block, wherein the at least one of the at least two different module components have connections that connect to the hydraulically operated components of the die casting machine, and, the end plates close unconnected inlet openings and outlet openings of the base block and/or of the at least one module component, wherein the device is arranged in the at least one row of the receiving frame that is disposed adjacent to the die casting machine.

10. The die casting machine according to claim 9, wherein the device is arranged in the at least one row of the receiving frame adjacent to the die casting machine such that the base block of the device connects the profile pieces of the at least one row at a bottom thereof.

11. The die casting machine according to claim 9, wherein 1 to 5 core-pulling modules are arranged above the base block, 1 to 5 booster modules are arranged above the core-pulling modules, and 1 to 5 secondary movement modules are arranged below the base block.

12. The die casting machine according to claim 9, wherein the die casting machine has a movable platen which has, on both sides, the receiving frame with the device arranged in the at least one row of the receiving frame adjacent to the die casting machine.

13. The die casting machine according to claim 12, wherein the device comprises, on one side of the movable platen, the base block having connections for connecting ejector cylinders.

14. A method for supplying to and/or controlling hydraulically operated components of a die casting machine comprising the steps of:

providing the device according to claim 1 on the die casting machine, introducing a hydraulic medium into the base block of the device, transferring the hydraulic medium through at least one of the base block connection openings or through at least one of the at least two different module component openings connection openings of the at least two module components.

15. The method according to claim 14, wherein the transferring of the hydraulic medium is modified by at least one unit.

* * * * *